US009964094B2

(12) United States Patent
Gallatz et al.

(10) Patent No.: US 9,964,094 B2
(45) Date of Patent: May 8, 2018

(54) INTERNAL COMBUSTION ENGINE

(71) Applicant: MWI Micro Wave Ignition AG, Empfingen (DE)

(72) Inventors: Armin Gallatz, Empfingen (DE); Volker Gallatz, Sulz-Bergfelden (DE)

(73) Assignee: MWI Micro Wave Ignition AG, Empfingen (DE)

( * ) Notice: Subject to any disclaimer, the term of this patent is extended or adjusted under 35 U.S.C. 154(b) by 22 days.

(21) Appl. No.: 15/043,818

(22) Filed: Feb. 15, 2016

(65) Prior Publication Data

US 2017/0002788 A1 Jan. 5, 2017

(51) Int. Cl.

| | |
|---|---|
| ***F02B 19/00*** | (2006.01) |
| ***F02P 23/04*** | (2006.01) |
| ***F02B 1/04*** | (2006.01) |
| ***F02F 1/18*** | (2006.01) |
| ***F02F 7/00*** | (2006.01) |

(52) U.S. Cl.

CPC ..... *F02P 23/045* (2013.01); *F02B 1/04* (2013.01); *F02F 1/18* (2013.01); *F02F 7/0087* (2013.01)

(58) Field of Classification Search

CPC ... F02P 23/045; F02B 1/04; F02F 1/18; F02F 7/0087; F02F 7/0085

USPC ..... 123/143 B

See application file for complete search history.

(56) References Cited

U.S. PATENT DOCUMENTS 4,297,983 A * 11/1981 Ward ..... F02P 23/04 123/193.6
4,545,238 A * 10/1985 Kinoshita ..... G01M 15/06 73/114.28
4,561,406 A * 12/1985 Ward ..... F02B 23/08 123/143 B
4,987,284 A * 1/1991 Fujimura ..... H01J 37/32357 156/345.41
6,158,383 A * 12/2000 Watanabe ..... C23C 16/511 118/723 AN
6,388,632 B1 * 5/2002 Murakawa ..... H01J 37/32192 118/723 MW (Continued)

FOREIGN PATENT DOCUMENTS

DE 10356916 A1 6/2005
DE 102011116340 5/2013

(Continued)

*Primary Examiner* — Carlos A Rivera
*Assistant Examiner* — Anthony Taylor, Jr.
(74) *Attorney, Agent, or Firm* — Von Rohrscheidt Patents

(57) ABSTRACT

An internal combustion engine including at least one cylinder with a piston moveable therein in an engine block in which microwaves are introduced into a combustion chamber through a microwave window, wherein the combustion chamber is formed by a piston base and a cylinder head, characterized in that the combustion chamber includes a combustion chamber wall which functions as a microwave window at least in portions wherein the combustion chamber wall is made from a wall layer that is made from a ceramic material in which wall layer at least one annular circumferential hollow conductor cavity is arranged with at least one inlet opening for the microwave and which includes at least one outlet opening for the microwave that is run in the annular hollow conductor cavity of the wall layer. In general the invention provides safe ignition of lean fuel air mixtures.

5 Claims, 2 Drawing Sheets

(56) References Cited

U.S. PATENT DOCUMENTS

| | | | | |
|---|---|---|---|---|
| 7,083,701 | B2 * | 8/2006 | Ohmi | H01J 37/32211 118/723 MW |
| 9,273,599 | B2 * | 3/2016 | Ikeda | F02P 9/007 |
| 2001/0036465 | A1 * | 11/2001 | Ishll | H01J 37/32192 424/400 |
| 2011/0030660 | A1 | 2/2011 | Ikeda | |
| 2011/0114261 | A1 * | 5/2011 | Matsumoto | H01J 37/32192 156/345.33 |
| 2014/0202411 | A1 * | 7/2014 | Ikeda | F02P 3/01 123/143 B |
| 2014/0312767 | A1 * | 10/2014 | Tian | H01J 37/32238 315/39 |

FOREIGN PATENT DOCUMENTS

| | | | |
|---|---|---|---|
| EP | 2065592 | A1 | 6/2009 |
| EP | 2687714 | A2 | 2/2014 |

* cited by examiner

INTERNAL COMBUSTION ENGINE

RELATED APPLICATIONS

This application claims priority from and incorporates by reference European Patent Application 15 157 315.1 filed on Mar. 3, 2015.

FIELD OF THE INVENTION

The invention relates to an internal combustion engine with at least one cylinder with a piston moveable therein in an engine block in which microwaves are introduced through a microwave window into a combustion chamber that is formed by a piston base and a cylinder head.

BACKGROUND OF THE INVENTION

DE 103 56 916 A1 discloses to generate a space ignition in a combustion chamber in an internal combustion engine in order to better ignite and combust a fuel air mixture of an introduced fuel.

In conventional engines an ignitable mixture is compressed in a cone shaped cylinder head and caused by a spark plug to react and oxidize. Thus, a chemical oxidation spreads cone shaped from an ignition location as a pressure and reaction front (laminar combustion gas phase). The pressure front moves faster than the reaction front and therefore reaches a cylinder edge first. The pressure front is reflected at the cylinder edge and runs towards the reaction front. When, both fronts meet the reaction can die down which degrades efficiency and causes pollutants.

Replacing the local ignition by a space ignition through microwaves mitigates this effect. Before. Ignition the mixture shall be excited over the entire volume as homogeneously as possible which requires absorption that is distributed over the combustion chamber. Thus, an absorption capability for microwaves described by a material parameter tan δ (t) and an associated penetration depth are important.

During compression a pressure and temperature dependent ionization of the mixture to be ignited is already being performed. Due to this ionization of particular fuel molecules absorption rates of the microwaves by the ignitable mixture in the combustion chamber have to be expected which, however, vary time based over the compression process.

Since the described homogeneity can never be achieved entirely in practical applications the reaction front shall run from an outside in inward direction. Therefore a microwave feed has to be found which generates a field distribution in the circular cylindrical combustion chamber wherein the field distribution increases homogeneously along the entire circumference and increases as homogeneously as possible along a radius or advantageously monotonously increases for larger radii. The homogeneity of the field distribution shall be rendered as independent as possible from absorption properties of the mixture.

BRIEF SUMMARY OF THE INVENTION

Thus, it is an object of the invention to achieve an ignition distribution in the entire combustion cavity that is a homogeneous as possible, or to generate local ignition cores at least in an edge portion of the combustion chamber.

The object is achieved by an internal combustion engine including at least one cylinder with a piston moveable therein in an engine block in which microwaves are injected into a combustion chamber through a microwave window, wherein the combustion chamber is formed by a piston base and a cylinder head, wherein the combustion chamber includes a combustion chamber wall which functions as a microwave window at least in portions of the combustion chamber wall, wherein the combustion chamber wall is made from a wall layer that is made from a ceramic material, wherein the wall layer includes at least one circumferential annular hollow conductor cavity, wherein the at least one circumferential annular hollow conductor cavity includes at least one inlet opening for the microwaves and at least one outlet opening for the microwaves that are run in the at least one circumferential annular hollow conductor cavity of the wall layer. Additional advantageous embodiments can be derived from the respective dependent claims.

Accordingly the internal combustion engine according to the invention runs the microwaves along the circumference of the combustion chamber and radially injected into the combustion chamber through at least a portion of a combustion chamber wall that acts as a microwave window. Thus, at least a portion of the combustion chamber wall, for example of the cylinder, can be made from a suitable material which performs the function of the microwave window for injecting the microwaves but which is suited for the combustion chamber at the same time due to its strength and temperature resistance. This can be for example a ceramic material, advantageously with a purity >99%. The microwaves can thus be run only in one plane or also in various planes in opposite directions or in identical directions about the combustion chamber and can be injected into the combustion chamber through the combustion chamber wall.

The microwaves are injected into the combustion chamber through at least one annular hollow conductor cavity arranged at the circumference of the combustion chamber wherein the hollow conductor cavity includes at least one outlet opening oriented towards the combustion chamber. Thus, the microwaves are introduced into an annular hollow conductor cavity providing optimum wave conduction while avoiding mode leaps and reflections wherein a cross section of the all annular hollow conductor cavity can be rectangular, especially square, circular or oval. The cross section is advantageously square in order to prevent flash overs in the annular hollow conductor cavity. The microwaves can be conducted at an end of the annular hollow conductor cavity into the combustion chamber at an angle in order to prevent reflections of the microwaves that have already run around the combustion chamber at an end of the annular conductor cavity back to a microwave source or in order to at least substantially mitigate those reflections. The microwaves are introduced with a frequency of 25 GHz to 90 GHz, advantageously 36 GHz since it has become apparent that these frequencies generate the desired space ignition in the combustion cavity. The microwaves can also be introduced in impulse packets wherein the impulse packets are advantageously also maintained after an ignition of a fuel air mixture has already been performed. Thus, the ignition of the fuel air mixture is optimized and the combustion of the fuel air mixture is further excited even after the ignition has already been performed and the combustion chamber may already be expanding.

In the internal combustion engine according to the invention the combustion chamber includes a combustion chamber wall that functions as a microwave window at least in portions and which is formed by a wall layer advantageously made from a ceramic material or from another solid material that is permeable for microwaves in which at least one circumferential annular hollow conductor cavity with at least one inlet opening for the microwave is arranged and which includes at least one outlet opening for the microwave that is run in the annular hollow conductor cavity of the wall layer. The annular hollow conductor cavity is formed when producing the wall layer which advantageously has the shape of a sleeve and the hollow conductor cavity as a matter of principle has metal walls. Thus, either a prefabricated metal annular hollow conductor cavity with a respective inlet opening and at least one outlet opening can be used or the annular hollow conductor cavity can be configured by inserting and applying metal surfaces in and onto the wall layer. According to the latter embodiment the annular hollow conductor cavity, contrary to its designation is not hollow, thus not configured as a free space but the material of the ceramic wall layer is arranged as a dielectric material between the metal walls. Regardless, the annular hollow conductor cavity acts as a hollow conductor with respect to the microwaves run therein.

Advantageously the annular hollow conductor cavity is formed by metal surfaces in a radially and in an axial direction of the wall layer, wherein a surface oriented towards the combustion chamber includes at least one opening for the outlet and the surface oriented towards the engine block includes at least one opening for an inlet of microwaves. The metal surfaces can be formed by inserted metal strips or at least at radial walls of the wall layer through externally applied metal coatings. On the motor block side also the metal motor block can provide the metal surface. Advantageously the annular hollow conductor cavity is defined at least in the axial direction of the wall layer by metal strips. Thus, the annular hollow conductor cavity can be prepared at least in the axial direction in a raw consistency before firing when producing the wall layer for example from ceramic material. In the radial direction metal strips can be inserted or subsequently applied at least to the combustion chamber wall as a metal layer.

According to one embodiment of the invention the annular hollow conductor cavity is advantageously defined in the radial direction of the wall layer at least partially by a metal layer that is applied, introduced or doted onto the respective wall (combustion chamber wall or radial outer wall), at least, however, onto the combustion chamber wall. Thus a thin metal layer (at least 3 μm) is applied to the combustion chamber wall in order to prevent that the microwaves are introduced into the combustion chamber at undesirable locations or optionally to define the annular hollow conductor cavity in outward direction. At locations where outlet openings for the microwaves are desired the metal layer on the combustion chamber wall is etched away and at locations where an inlet opening is desired the layer on the radial outer wall is etched away.

Advantageously in order to avoid reflections at an end of the annular conductor cavity a wall is arranged at this location that is disposed at an angle relative to the annular hollow conductor cavity and an outlet opening in a direction towards the combustion chamber wall. Thus, advantageously the wall arranged at an angle can be made from metal and can be advantageously adjacent to the inlet opening with the other side.

The internal combustion engine advantageously can include a circumferential gap between the annular hollow conductor cavity and the combustion chamber wall, wherein the gap increases in size with the length of the path of the microwave in the annular hollow conductor cavity or the internal combustion engine can particularly advantageously include a plurality of gaps that are arranged perpendicular to the propagation direction of the microwave between the annular hollow conductor cavity and the combustion chamber wall or the internal combustion engine can include a combination thereof. These measures are used to concentrate microwave energy at a sufficient level at as many locations in the combustion chamber as possible in order to generate a space ignition in the combustion chamber through a plethora of ignition cores. As a matter of principle the gaps can vary with a length of a path of the microwave in the annular hollow conductor cavity.

As a matter of principle an additional advantageously identical annular hollow conductor cavity can be arranged adjacent to the annular hollow conductor cavity wherein the additional annular hollow conductor cavity is for example advantageously arranged with outlet openings that are offset relative to the outlet openings of the first annular hollow conductor cavity and so that the additional annular hollow conductor cavity has a feed that is arranged opposite annular4 hollow conductor cavity. Additionally points for local field augmentation and generation of ignition cores can be provided in the combustion cavity, in particular in the cylinder head. If necessary at least one additional microwave spark plug according to the co-owned application EP 15 15 72 98.9 can be arranged in the cylinder head.

The mathematical description of the injection is based on a cylinder coordinate system r, φ, z. In a circular cylindrical space that is defined with electrically conductive borders a distribution of the electromagnetic waves along the circumference is defined by sine- or cosine functions and defined by cylinder functions also designated Bessel functions along the radius. Depending on an orientation of the field lines the associated Eigen modes are designated T $E_{mn}$, T or $M_{mn}$ modes. Thus, the first index m corresponds to the number of azimuthal maxima, the second index n corresponds to the number of radial maxima. Modes with high azimuthal index and low radial index are designated as Whispering Gallery Modes WGM. Their power oscillates substantially at an edge of the hollow cylinder. With increasing radial index the oscillating power moves into the interior of the combustion chamber.

A superposition of two modes that are offset by π/(2m) azimuthally and time based but which are identical otherwise lead to a rotating mode. These are quite well known in literature. Mathematically an azimuthally standing mode is expressed by two counter rotating modes using the following equation:

$$2\cos m\varphi e^{-i\omega t}=(0^{im\varphi}+e^{-im\varphi})e^{-i\omega t}$$

In case m=0 there is an azimuthally constant distribution.

A similar equation applies in radial direction. The Bessel function describing radially standing waves can be broken down into inward and outward propagating Hankel functions:

$$2J_m(k_r r)=H_{m2}(k_r r)+H_{m1}(k_r r)$$

wherein kr is the radial wave number. A field distribution proportional to $$e^{im\varphi}*H_{m2}(k_r r)$$

describes a mode whose power propagates inward in a spiral shape. The associated face fronts become steeper and steeper with decreasing radius.

According to the invention an ignition with maximum homogeneity along the circumference is optionally achieved in an outer portion of the cylinder or in the entire volume in that either a rotating Whispering Gallery Mode or a volume mode is excited in the combustion cavity in a controlled manner. Thus, a feed wave conductor, advantageously a rectangular wave conductor in the form of the annular hollow conductor cavity is wound about the combustion chamber. From theory it is known that the hollow conductor wave length of its modes can be changed by the transversal geometric dimensions. The feed wave conductor and the cylindrical combustion cavity are therefore connected with each other in one embodiment by periodic openings through the combustion cavity wall acting as microwave window which injects power from the wave conductor into the combustion cavity. Now the period p of the openings is selected so that $$p = \frac{2*\pi}{k_i}$$

wherein $k_l$ is the axial wave number of the mode in the wound wave conductor which excites a T $E_{0n}$ mode in the combustion chamber in a controlled manner. This mode in an ideal case would have circular inward running face fronts with constant amplitude. The fed in power reaches the opposite wall directly and can already be injected back into the wound feed wave conductor at this location. The covered path length in the combustion cavity thus corresponds to a diameter of the combustion cavity. In case of bad absorption of the mix to be ignited a considerable portion of the power is injected back into the feed wave conductor and reflected to the microwave source.

Therefore a slightly different period of the openings is selected as an alternative according to the invention. Thus, the face fronts are inclined. The power propagates in a spiral shape into the combustion cavity which facilitates a high path length and thus an absorption of the microwave power that is largely independent from tan δ. The width of the openings is varied so that the power injected into the combustion chamber is constant along the circumference.

As described supra the surfaces with constant phase are inclined the more relative to the radius, the smaller the radius becomes. There is a radius at which the power only propagates in the azimuthal direction. This leads to a portion without field in an interior of the combustion chamber. This is advantageous when a fuel concentration is low in a center of the combustion chamber. The excited modes correspond to the already recited Whispering Gallery Modes. This coupling is reached in a particularly efficient manner when the wave length in the wound wave conductor is shortened relative to the clear space wave length. Thus, the wave conductor is filled with a non absorbing dielectric material.

Strong field augmentations can be obtained at the edge with simultaneously comparatively weaker excitation of the field in a center in that the injecting period is selected so that injecting is performed into a volume mode as well as into a WGM. This yields a field augmentation in edge portions.

The excitation of the fields at an edge of the combustion chamber can also be controlled time based. Initially a frequency is selected at which an injection is performed by the feed wave conductor into the volume mode exciting the entire combustion chamber. The frequency can be changed subsequently so that an injection is performed into an igniting WGM.

At an end of the wound wave conductor a plate can be arranged that is inclined by an angle of 45° and that rotates the polarization. The microwave power reaching the end of the wound conductor is then reflected in a rotated polarization. The power injected into the combustion cavity in the 90° rotated polarization does not interfere with the power injected in forward direction then.

The invention thus facilitates precise control of a beginning of a space ignition of a fuel air mixture in a combustion chamber so that an optimum low emission combustion of the fuel is achieved with increased efficiency compared to conventional reciprocating piston internal combustion engines. Typically the invention facilitates safe ignition of lean fuel air mixtures which does not require additional enrichment for achieving ignition and which leads to a lower fuel consumption. Emissions and their generation can be controlled by the combustion temperature and the mix ratio of air and fuel. Combustion according to the invention occurs faster than for conventional ignitions. This causes "colder" combustion so that the efficiency increases. Furthermore lower pollutant emissions are achieve able through colder combustion processes as a matter of principle. The colder combustion reduces the concentration of NO in the exhaust gases. Through space ignition the combustion process, differently from conventional combustion is much less dependent on combustion progress m the form of diffusion flames. This helps to avoid additional heat losses and achieves an efficient increase. A heat up phase of the combustion chamber and of the air in the oxidation portion is not provided for this type of combustion.

BRIEF DESCRIPTION OF THE DRAWINGS

The invention is subsequently can be described in more detail with reference to schematic drawing figures. Additional features of the invention can be derived from the subsequent description in combination with the patent claims and the appended drawing figures, wherein:

DETAILED DESCRIPTION OF THE INVENTION

Figure 1:
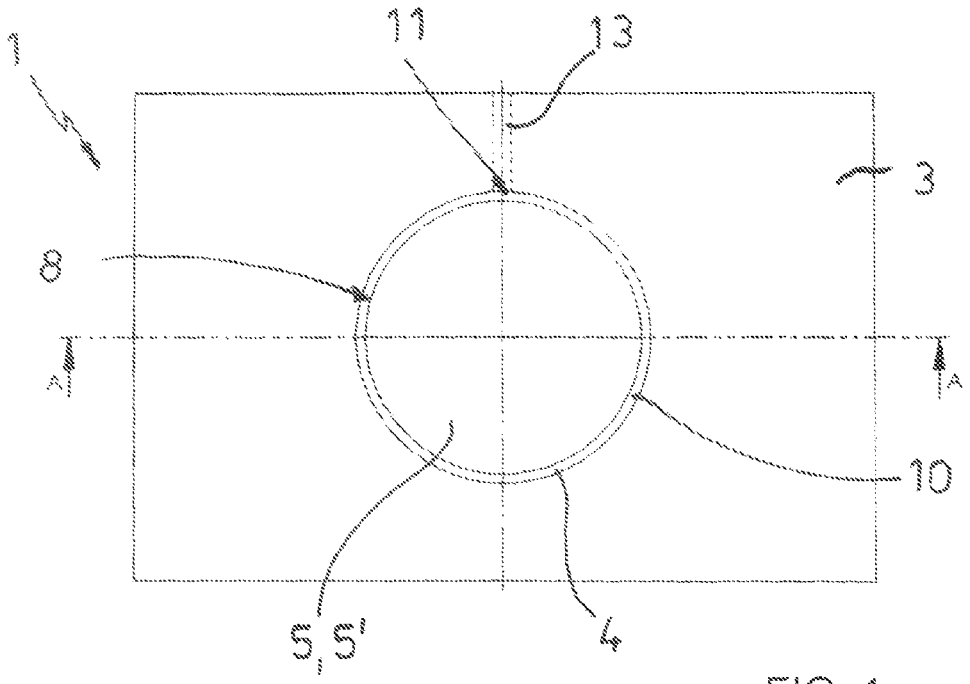
FIG. 1 illustrates a detail of an internal combustion engine in a top view without cylinder head.
Figure 2:
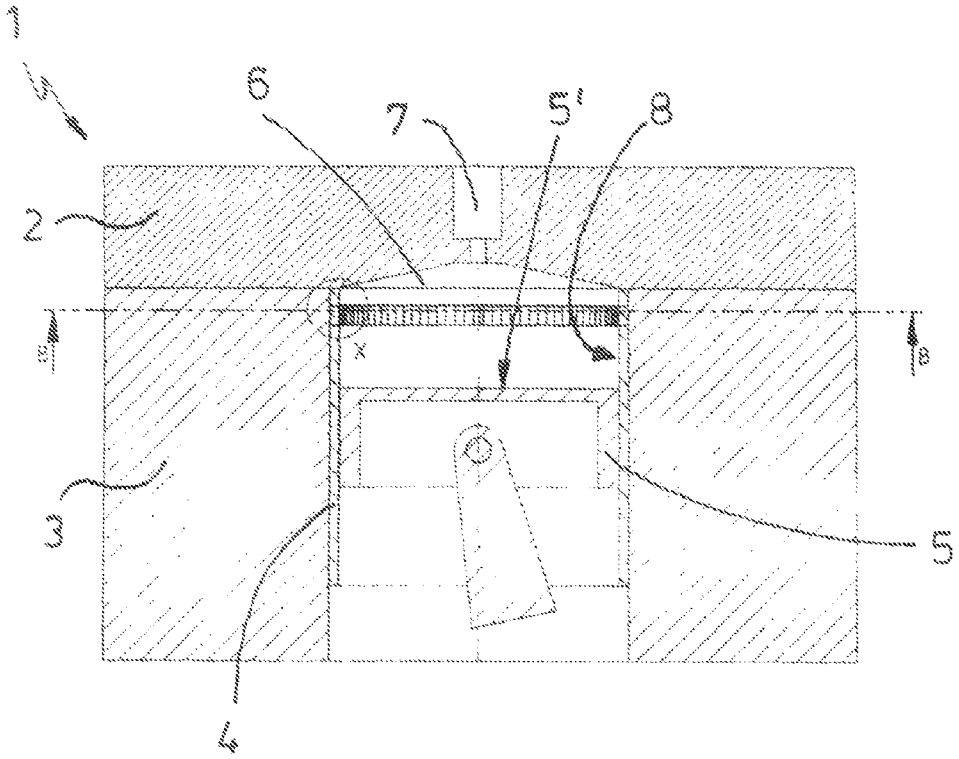
FIG. 2 illustrates a sectional view along the line A-A of the detail of FIG. A with a cylinder head.
Figure 3:
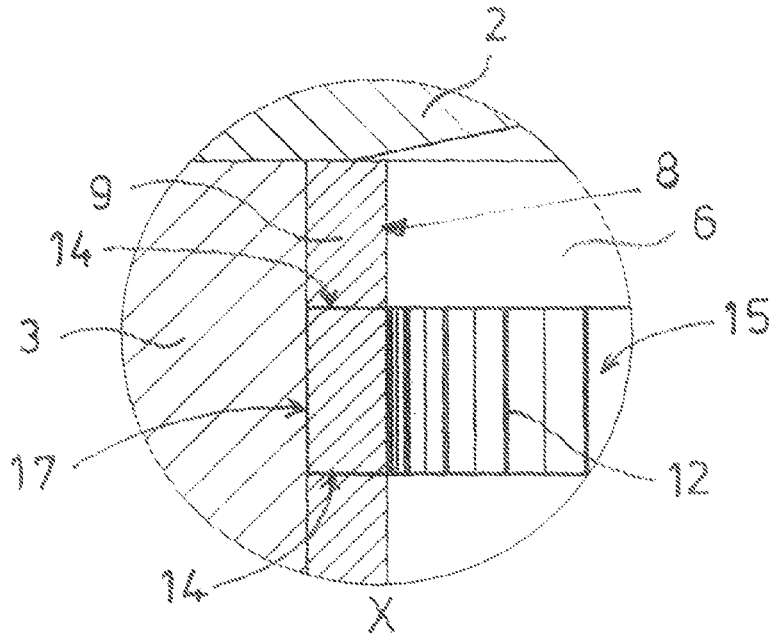
FIG. 3 illustrates a blown up view of the detail X in FIG. B.
Figure 4:
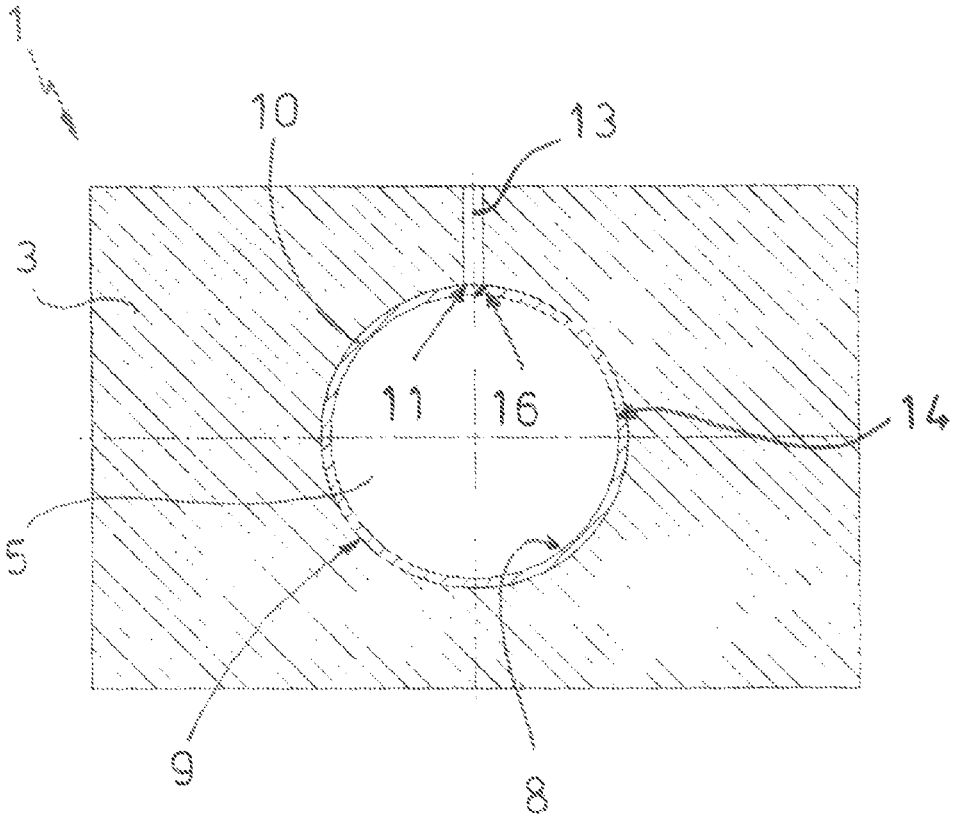
FIG. 4 illustrates a sectional view along the line B-B of FIG. B.

The individual figures are subsequently described jointly since there is only one embodiment that is illustrated in different views. The figures schematically illustrate a detail of an internal combustion engine 1 with a cylinder head 2 and an engine block 3. The engine block 3 includes a cylinder 4 with a piston 5 that is moveable therein and a combustion chamber 6 that is arranged above the cylinder 4 partially in the cylinder head 2 between the piston base 5' and the cylinder head 2. A schematically illustrated inlet 7 for the fuel air mixture leads into the combustion chamber 6. Outlets for an exhaust gas which can be configured in a manner that is known to a person skilled in the art are not illustrated. The schematically illustrated cylinder head 2 with a central inlet 7 for the fuel air mixture can certainly include additional spark plugs or outlets for exhaust gases. The cylinder 4 includes an additional inner wall 8 which is made from a material which is suitable to perform a function of a microwave window. This can be for example a ceramic material, advantageously with a high level of purity or another suitable microwave permeable and abrasion resistant material.

The combustion chamber wall 8 is formed by a wall layer provided as a sleeve shaped running bushing 9 formed from a ceramic material that is arranged in the cylinder 4, wherein an annular hollow conductor cavity 10 is arranged in the wall of the sleeve shaped running bushing. The annular hollow conductor cavity 10 is connected with a feed 16 for the microwaves which is connectable outside of the engine block 3 to a non illustrated energy source and whose end oriented towards the annular hollow conductor cavity 10 forms the inlet opening 11 into the annular hollow conductor cavity 10 for the microwaves. In the wall of the running bushing 9 the annular hollow conductor cavity 10 is defined in axial direction by metal strips 14 inserted before sintering (can also be doted). Additionally a slanted divider wall 16 is arranged at an outlet of the feed 16 into the annular hollow conductor cavity 10 wherein the divider wall is used for deflecting the incoming microwave into the annular hollow conductor cavity 10 and for deflecting into the combustion chamber 6 after running about the annular hollow conductor cavity 10. Additionally this prevents back reflections of the microwave. The radial walls of the annular hollow conductor cavity 10 are formed at the radial outer wall of the running bushing 9 by the metal wall 17 of the engine block 3 and are formed at the combustion chamber wall 8 by a metal layer 15 applied by well-known methods. The metal layer 15 is etched away at locations where the microwaves shall exit. The embodiment shows multiple outlet openings 12 configured as gaps which are evenly distributed over a length of the annular hollow conductor cavity 10. This provides an injection of the microwave energy as described supra.

Components of the engine like engine block, cylinder head etc. are made from a typical material, typically metal, wherein the material can be selected according to the application. The boundary for the microwaves in the illustrated hollow conductor cavities is made from metal, wherein additional measures can be taken in order to optimize conductivity, for example by surface coating with a highly electrically conductive material.

What is claimed is:

1. An internal combustion engine, comprising:

at least one cylinder with a piston moveable therein in an engine block in which microwaves are injected into a combustion chamber through a microwave window, wherein the combustion chamber is formed by a piston base and a cylinder head, wherein the combustion chamber includes a combustion chamber wall which functions as a microwave window at least in portions of the combustion chamber wall, wherein the combustion chamber wall is made from a ceramic material, wherein the combustion chamber wall includes at least one circumferential annular hollow conductor cavity, wherein the at least one circumferential annular hollow conductor cavity includes at least one inlet opening for the microwaves and at least one outlet opening for the microwaves that are run in the at least one circumferential annular hollow conductor cavity of the combustion chamber wall, wherein the at least one circumferential annular hollow conductor cavity is formed as a running bushing for the piston in the engine block, wherein the at least one circumferential annular hollow conductor cavity is defined in an axial direction of the running bushing by inserted or coated metal surfaces, and wherein the at least one circumferential annular hollow conductor cavity is defined in a radial direction of the running bushing by at least partial metal coating of the running bushing.

2. The internal combustion engine according to claim 1, wherein a plurality of gaps are provided between the at least one circumferential annular hollow conductor cavity and the combustion chamber wall, wherein the plurality of gaps are arranged perpendicular to a propagation direction of the microwaves.

3. The internal combustion engine according to claim 1, wherein the engine block includes a feed for the microwaves which ends at the at least one inlet opening of the at least one circumferential annular hollow conductor cavity.

4. The internal combustion engine according to claim 1, wherein the at least one inlet opening for the microwaves is arranged at a first end of the at least one circumferential annular hollow conductor cavity and includes a first wall surface that is oriented at a first angle relative to the at least one circumferential annular hollow conductor cavity and deflects the microwaves into the at least one circumferential annular hollow conductor cavity, wherein the at least one outlet opening for the microwaves is arranged at a second end of the at least one circumferential annular hollow conductor cavity and includes a second wall surface that is oriented at a second angle relative to the at least one circumferential annular hollow conductor cavity and deflects the microwaves from the at least one circumferential annular hollow conductor cavity into the combustion chamber.

5. The internal combustion engine according to claim 4, wherein the first wall surface and the second wall surface are arranged on opposite sides of a metal wall.

* * * * *